US010323831B2

(12) United States Patent
Harvey et al.

(10) Patent No.: US 10,323,831 B2
(45) Date of Patent: Jun. 18, 2019

(54) UTILITY MOUNT LIGHT

(71) Applicant: MILWAUKEE ELECTRIC TOOL CORPORATION, Brookfield, WI (US)

(72) Inventors: Kyle Harvey, Wauwatosa, WI (US); Jason D. Thurner, Menomonee Falls, WI (US); David Proeber, Milwaukee, WI (US); Justin D. Dorman, Wauwatosa, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 141 days.

(21) Appl. No.: 15/349,689

(22) Filed: Nov. 11, 2016

(65) Prior Publication Data

US 2017/0138575 A1 May 18, 2017

Related U.S. Application Data

(60) Provisional application No. 62/255,078, filed on Nov. 13, 2015.

(51) Int. Cl.

| | |
|---|---|
| ***F21L 4/02*** | (2006.01) |
| ***F21L 4/04*** | (2006.01) |
| ***F21V 21/14*** | (2006.01) |
| ***F21V 21/30*** | (2006.01) |
| ***F21V 21/40*** | (2006.01) |

(Continued)

(52) U.S. Cl.

CPC ..... *F21V 21/145* (2013.01); *F21L 4/027* (2013.01); *F21L 4/04* (2013.01); *F21V 21/0885* (2013.01); *F21V 21/30* (2013.01); *F21V 21/406* (2013.01); *F21V 23/0414* (2013.01)

(58) Field of Classification Search

CPC ..... F21L 4/027; F21L 4/04; F21V 21/145; F21V 21/30; F21V 23/0414; F21V 21/0885; F21V 21/406; F21V 21/108

See application file for complete search history.

(56) References Cited

U.S. PATENT DOCUMENTS

| | | | |
|---|---|---|---|
| 3,331,958 | A | 7/1967 | Adler |
| 4,032,771 | A | 6/1977 | Ilzig |

(Continued)

FOREIGN PATENT DOCUMENTS

| | | |
|---|---|---|
| EP | 0193756 | 9/1986 |
| EP | 1205428 | 5/2002 |

(Continued)

OTHER PUBLICATIONS

Extended European Search Report for Application No. 16198619.5 dated Mar. 1, 2017 (9 pages).

(Continued)

*Primary Examiner* — Peggy A Neils

(74) *Attorney, Agent, or Firm* — Michael Best & Friedrich LLP

(57) ABSTRACT

A utility light includes a main body, a handle movably coupled to the main body, and a pair of light assemblies. The handle is biased toward the main body such that the handle is configured to clamp a workpiece between the main body and the handle. Each of the light assemblies is defined on the main body and includes a light source disposed within a light housing. The light housings are each pivotally supported within a yoke that is rotatable relative to the main body.

18 Claims, 8 Drawing Sheets

(51) Int. Cl.
*F21V 23/04* (2006.01)
*F21V 21/088* (2006.01)

(56) References Cited

U.S. PATENT DOCUMENTS 4,228,489 A 10/1980 Martin
4,268,894 A 5/1981 Bartunek et al.
4,324,477 A 4/1982 Miyazaki
5,203,621 A 4/1993 Weinmeister et al.
5,207,747 A 5/1993 Gordin et al.
5,351,172 A 9/1994 Attree et al.
5,400,234 A 3/1995 Yu
5,428,520 A 7/1995 Skief
5,630,660 A 5/1997 Chen
5,934,628 A 8/1999 Bosnakovic
5,944,407 A 8/1999 Lynch et al.
5,964,524 A 10/1999 Qian
6,045,240 A 4/2000 Hochstein
D428,176 S 7/2000 Bamber et al.
6,092,911 A 7/2000 Baker, III et al.
6,099,142 A 8/2000 Liu
6,149,283 A 11/2000 Conway et al.
6,183,114 B1 2/2001 Cook et al.
6,213,626 B1 4/2001 Qian
6,255,786 B1 7/2001 Yen
6,265,969 B1 7/2001 Shih
D452,022 S 12/2001 Osiecki et al.
6,367,949 B1 4/2002 Pederson
6,379,023 B1 4/2002 Passno
6,461,017 B2 10/2002 Selkee
6,474,844 B1 11/2002 Ching
6,554,459 B2 4/2003 Yu et al.
6,637,904 B2 10/2003 Hernandez
6,824,297 B1 11/2004 Lee
6,854,862 B1 2/2005 Hopf
6,857,756 B2 2/2005 Reiff et al.
6,873,249 B2 3/2005 Chu
6,899,441 B2 3/2005 Chen
6,877,881 B2 4/2005 Tsao
D506,847 S 6/2005 Hussaini et al.
6,902,294 B2 6/2005 Wright
6,926,428 B1 8/2005 Lee
7,001,044 B2 2/2006 Leen
7,001,047 B2 2/2006 Holder et al.
7,011,280 B2 3/2006 Murray et al.
7,063,444 B2 6/2006 Lee et al.
7,073,926 B1 7/2006 Kremers et al.
D529,926 S 10/2006 Krieger et al.
D532,536 S 11/2006 Krieger et al.
7,152,997 B1 12/2006 Kovacik et al.
7,153,004 B2 12/2006 Galli
7,194,358 B2 3/2007 Callaghan et al.
7,195,377 B2 3/2007 Tsai
7,224,271 B2 5/2007 Wang
D549,859 S 8/2007 Kovacik et al.
D553,281 S 10/2007 Rugendyke et al.
D553,771 S 10/2007 Watson et al.
7,278,761 B2 10/2007 Kuan
D556,353 S 11/2007 Gebhard et al.
7,350,940 B2 4/2008 Haugaard et al.
7,364,320 B2 4/2008 Van Deursen et al.
7,367,695 B2 5/2008 Shiau
7,470,036 B2 12/2008 Deighton et al.
7,484,858 B2 2/2009 Deighton et al.
7,503,530 B1 3/2009 Brown
D593,236 S 5/2009 Ng et al.
7,566,151 B2 7/2009 Whelan et al.
7,618,154 B2 11/2009 Rosiello
7,638,970 B1 12/2009 Gebhard et al.
7,670,034 B2 3/2010 Zhang et al.
7,798,684 B2 9/2010 Boissevain
7,828,465 B2 11/2010 Roberge et al.
7,857,486 B2 12/2010 Long et al.
7,914,178 B2 3/2011 Xiang et al.
7,914,182 B2 3/2011 Mrakovich et al.
7,972,036 B1 7/2011 Schach et al.
D643,138 S 8/2011 Kawase et al.
7,988,335 B2 8/2011 Liu et al.
7,990,062 B2 8/2011 Liu
7,997,753 B2 8/2011 Walesa et al.
8,007,128 B2 8/2011 Wu et al.
8,007,145 B2 8/2011 Leen
8,029,169 B2 10/2011 Liu
8,047,481 B2 11/2011 Shen
8,087,797 B2 1/2012 Pelletier et al.
8,142,045 B2 3/2012 Peak
8,167,466 B2 5/2012 Liu
8,201,979 B2 6/2012 Deighton et al.
D665,521 S 8/2012 Werner et al.
8,235,552 B1 8/2012 Tsuge
8,262,246 B2 * 9/2012 Pelletier ..... F21L 4/04 362/191
8,262,248 B2 9/2012 Wessel
8,294,340 B2 10/2012 Yu et al.
8,322,892 B2 12/2012 Scordino et al.
8,328,398 B2 12/2012 Van Deursen
8,330,337 B2 12/2012 Yu et al.
8,360,607 B2 1/2013 Bretschneider et al.
8,366,290 B2 2/2013 Maglica
8,403,522 B2 3/2013 Chang
D679,845 S 4/2013 Huang
8,425,091 B2 4/2013 Chen
8,439,531 B2 5/2013 Trott et al.
8,465,178 B2 6/2013 Wilcox et al.
8,485,691 B2 7/2013 Hamel et al.
8,547,022 B2 10/2013 Summerford et al.
D695,434 S 12/2013 Shen
8,599,097 B2 12/2013 Intravatola
D698,471 S 1/2014 Poon
D699,874 S 2/2014 Chilton et al.
8,651,438 B2 2/2014 Deighton et al.
8,659,433 B2 2/2014 Petrou
D702,863 S 4/2014 Kotsis
D703,354 S 4/2014 Kotsis
D703,355 S 4/2014 Kotsis
D703,851 S 4/2014 Gebhard et al.
8,692,444 B2 4/2014 Patel et al.
8,696,177 B1 4/2014 Frost
D705,467 S 5/2014 Aglassinger
8,757,815 B2 * 6/2014 Saruwatari ..... G03B 21/145 353/87
D708,376 S 7/2014 Crowe et al.
8,801,226 B2 8/2014 Moore
8,840,264 B2 * 9/2014 Molina ..... F21V 21/088 362/109
8,851,699 B2 10/2014 McMillan
8,858,016 B2 10/2014 Strelchuk
8,858,026 B2 10/2014 Lee et al.
8,939,602 B2 1/2015 Wessel
8,979,331 B2 3/2015 Lee et al.
D726,354 S 4/2015 Davies
9,010,279 B1 4/2015 Saber et al.
D728,402 S 5/2015 Case
9,068,736 B2 6/2015 Lee et al.
D734,886 S 7/2015 Lazalier et al.
D737,487 S 8/2015 Beckett et al.
D744,139 S 11/2015 Itoh et al.
9,188,320 B2 11/2015 Russello et al.
9,205,774 B2 * 12/2015 Kennemer ..... F21L 14/00
D747,263 S 1/2016 Lafferty
D750,822 S 3/2016 Hernandez et al.
D759,291 S 6/2016 Chen
D774,139 S 12/2016 Newson
D774,231 S 12/2016 Recker et al.
D774,674 S 12/2016 Hanwell
D776,320 S 1/2017 Bobel
9,539,952 B2 1/2017 Gebhard et al.
D781,480 S 3/2017 Zhan
D782,718 S 3/2017 Ko
9,596,776 B2 3/2017 Takahashi et al.
D788,180 S 5/2017 Mantes et al.
D804,074 S 11/2017 Fang
2002/0136005 A1 9/2002 Lee
2002/0167814 A1 11/2002 Ching

(56) References Cited

U.S. PATENT DOCUMENTS

| | | | |
|---|---|---|---|
| 2003/0090904 | A1 | 5/2003 | Ching |
| 2003/0137847 | A1 | 7/2003 | Cooper |
| 2003/0174503 | A1 | 9/2003 | Yueh |
| 2004/0228117 | A1 | 11/2004 | Witzel et al. |
| 2005/0201085 | A1 | 9/2005 | Aikawa et al. |
| 2006/0007682 | A1 | 1/2006 | Reiff, Jr. et al. |
| 2006/0067077 | A1 | 3/2006 | Kumthampinij et al. |
| 2006/0146550 | A1 | 7/2006 | Simpson et al. |
| 2006/0279948 | A1 | 12/2006 | Tsai |
| 2006/0285323 | A1 | 12/2006 | Fowler |
| 2007/0211470 | A1 | 9/2007 | Huang |
| 2007/0297167 | A1 | 12/2007 | Greenhoe |
| 2008/0112170 | A1 | 5/2008 | Trott et al. |
| 2008/0158887 | A1 | 7/2008 | Zhu et al. |
| 2008/0165537 | A1 | 7/2008 | Shiau |
| 2008/0198588 | A1 | 8/2008 | O'Hern |
| 2008/0253125 | A1 | 10/2008 | Kang et al. |
| 2008/0302933 | A1 | 12/2008 | Cardellini |
| 2009/0080205 | A1 | 3/2009 | Chang et al. |
| 2009/0097263 | A1 | 4/2009 | Ko et al. |
| 2009/0116230 | A1 | 5/2009 | Young |
| 2009/0134191 | A1 | 5/2009 | Phillips |
| 2009/0135594 | A1 | 5/2009 | Yu et al. |
| 2009/0284963 | A1 | 11/2009 | Intravatola |
| 2009/0303717 | A1 | 12/2009 | Long et al. |
| 2010/0027260 | A1 | 2/2010 | Liu |
| 2010/0027269 | A1 | 2/2010 | Lo et al. |
| 2010/0072897 | A1 | 3/2010 | Zheng |
| 2010/0080005 | A1 | 4/2010 | Gattari |
| 2010/0091495 | A1 | 4/2010 | Patrick |
| 2010/0142213 | A1 | 6/2010 | Bigge et al. |
| 2010/0315824 | A1 | 12/2010 | Chen |
| 2010/0328951 | A1 | 12/2010 | Boissevain |
| 2011/0031887 | A1 | 2/2011 | Stoll et al. |
| 2011/0038144 | A1 | 2/2011 | Chang |
| 2011/0050070 | A1 | 3/2011 | Pickard |
| 2011/0058367 | A1 | 3/2011 | Shiau et al. |
| 2011/0075404 | A1 | 3/2011 | Allen et al. |
| 2011/0121727 | A1 | 5/2011 | Sharrah et al. |
| 2011/0228524 | A1 | 9/2011 | Greer |
| 2011/0286216 | A1 | 11/2011 | Araman |
| 2011/0317420 | A1 | 12/2011 | Jeon et al. |
| 2012/0026729 | A1 | 2/2012 | Sanchez et al. |
| 2012/0033400 | A1 | 2/2012 | Remus et al. |
| 2012/0033429 | A1 | 2/2012 | Van De Ven |
| 2012/0044707 | A1 | 2/2012 | Breidenassel |
| 2012/0048511 | A1 | 3/2012 | Moshtagh |
| 2012/0049717 | A1 | 3/2012 | Lu |
| 2012/0057351 | A1 | 3/2012 | Wilcox et al. |
| 2012/0087118 | A1 | 4/2012 | Bailey et al. |
| 2012/0087125 | A1 | 4/2012 | Liu |
| 2012/0098437 | A1 | 4/2012 | Smed |
| 2012/0120674 | A1 | 5/2012 | Jonker |
| 2012/0140455 | A1 | 6/2012 | Chang |
| 2012/0155104 | A1 | 6/2012 | Jonker |
| 2012/0212963 | A1 | 8/2012 | Jigamian |
| 2012/0234519 | A1 | 9/2012 | Lee |
| 2012/0236551 | A1 | 9/2012 | Sharrah et al. |
| 2012/0247735 | A1 | 10/2012 | Ito et al. |
| 2012/0262917 | A1 | 10/2012 | Courcelle |
| 2012/0300487 | A1 | 11/2012 | Jonker |
| 2013/0032323 | A1 | 2/2013 | Hsu |
| 2013/0058078 | A1 | 3/2013 | Meng |
| 2013/0077296 | A1 | 3/2013 | Goeckel et al. |
| 2013/0128565 | A1 | 5/2013 | Cugini et al. |
| 2013/0176713 | A1 | 7/2013 | Deighton et al. |
| 2013/0187785 | A1 | 7/2013 | McIntosh et al. |
| 2013/0258645 | A1 | 10/2013 | Weber et al. |
| 2013/0265780 | A1 | 10/2013 | Choksi et al. |
| 2013/0322073 | A1 | 12/2013 | Hamm et al. |
| 2014/0126192 | A1 | 5/2014 | Ancona et al. |
| 2014/0140050 | A1 | 5/2014 | Wong et al. |
| 2014/0192543 | A1 | 7/2014 | Deighton et al. |
| 2014/0218936 | A1 | 8/2014 | Mahling et al. |
| 2014/0268775 | A1 | 9/2014 | Kennemer et al. |
| 2014/0301066 | A1 | 10/2014 | Inskeep |
| 2014/0307443 | A1 | 10/2014 | Clifford et al. |
| 2014/0376216 | A1 | 12/2014 | McLoughlin et al. |
| 2015/0023771 | A1 | 1/2015 | Carr et al. |
| 2015/0198298 | A1* | 7/2015 | Scarlata ..... F21S 9/00 362/184 |
| 2015/0233569 | A1 | 8/2015 | Xue et al. |
| 2015/0233571 | A1 | 8/2015 | Inan et al. |
| 2016/0354664 | A1 | 12/2016 | DeCarlo |
| 2016/0356439 | A1* | 12/2016 | Inskeep ..... H02J 7/0052 |
| 2017/0138575 | A1 | 5/2017 | Harvey et al. |
| 2017/0204864 | A1 | 7/2017 | Mantes et al. |
| 2017/0331163 | A1 | 11/2017 | Ebner et al. |

FOREIGN PATENT DOCUMENTS

| | | |
|---|---|---|
| EP | 2436641 | 4/2012 |
| GB | 2424694 | 10/2006 |
| GB | 2468740 | 9/2010 |
| KR | 20100116933 | 11/2010 |
| WO | 2002044503 | 6/2002 |
| WO | 2014083117 | 6/2014 |
| WO | 2014207595 | 12/2014 |

OTHER PUBLICATIONS

European Patent Office Action for Application No. 16198619.5 dated May 18, 2018, 5 pages.

* cited by examiner

UTILITY MOUNT LIGHT

CROSS-REFERENCE TO RELATED APPLICATIONS

This application claims priority to U.S. Provisional Patent Application No. 62/255,078 filed on Nov. 13, 2015, the entire content of which is incorporated herein by reference.

FIELD OF THE INVENTION

The present invention relates to utility lights.

SUMMARY OF THE INVENTION

The present invention provides, in one aspect, a utility light including a main body, a light assembly that is defined on the main body, and a handle that is movably coupled to the main body. The light assembly includes a light source disposed within a light housing that is pivotable and rotatable relative to the main body. The handle is configured to engage a workpiece to support the utility light on the workpiece.

The present invention provides, in another aspect, a utility light including a main body, a first light assembly, a second light assembly, and a handle. The first light assembly is defined on the main body and includes a first light source disposed within a first light housing that is pivotable and rotatable relative to the main body. The second light assembly is defined on the main body and includes a second light source disposed within a second light housing that is pivotable and rotatable relative to the main body. The handle includes a portion that is movably coupled to the main body, and the handle is configured to engage a workpiece to support the utility light on the workpiece.

The present invention provides, in another aspect, a utility light including a main body, a handle pivotally coupled to the main body, a first light assembly defined on the main body, and a second light assembly defined on the main body. The handle is biased toward the main body such that the handle is configured to clamp a workpiece between the main body and the handle. The first light assembly includes a first light source disposed within a first light housing that is pivotally supported within a first yoke that is rotatable degrees relative to the main body. The second light assembly includes a second light source disposed within a second light housing that is pivotally supported with a second yoke that is rotatable degrees relative to the main body.

Other features and aspects of the invention will become apparent by consideration of the following detailed description and accompanying drawings.

Figure 1:
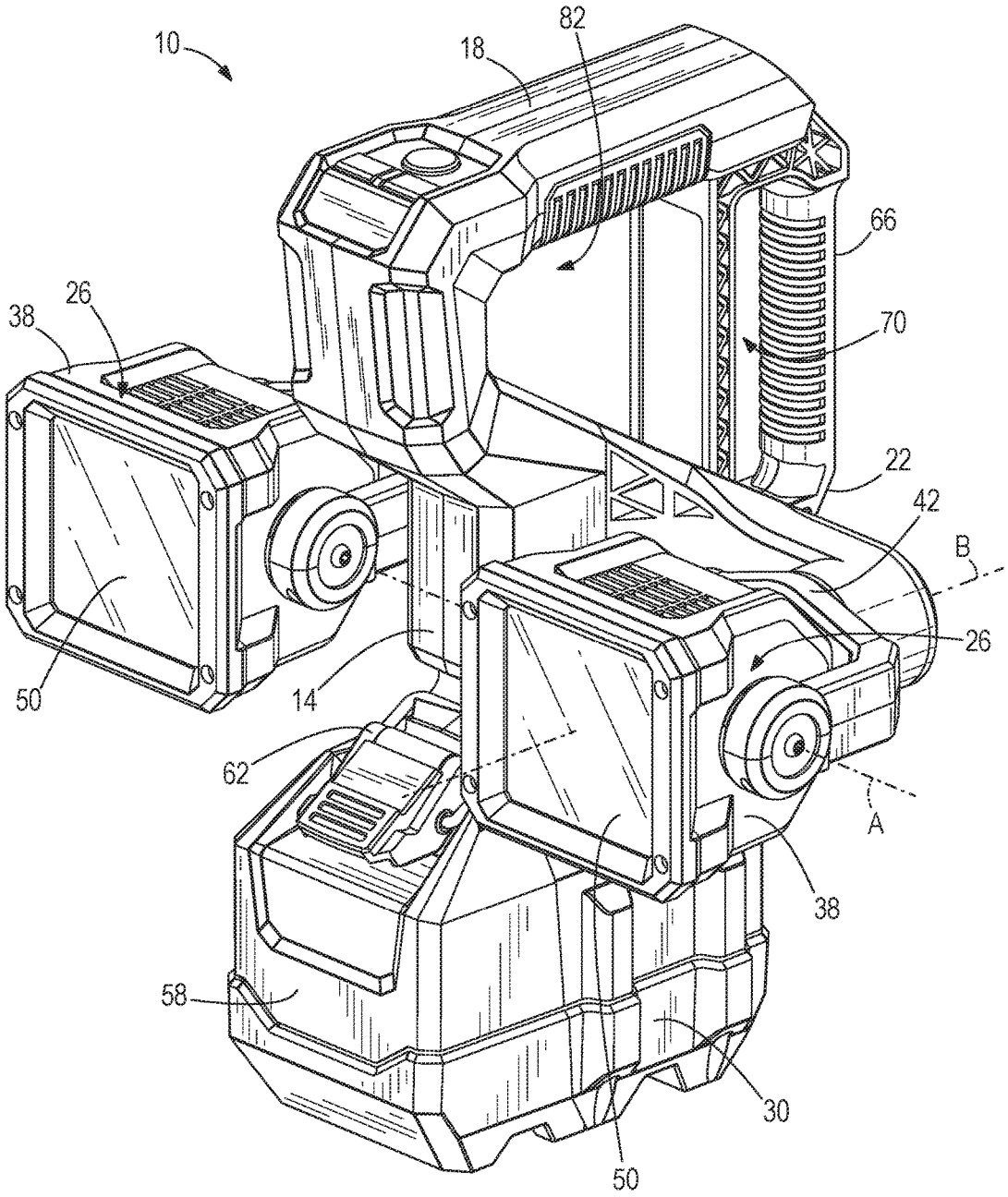
FIG. 1 is a front perspective view of a utility mount light.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

FIGS. 1-5 illustrate a utility mount light 10 including a main housing 14, a handle portion 18 supporting a handle 22, a pair of rotatable light head assemblies 26, and a battery support portion 30 configured to detachably couple a battery pack (not shown). As explained in greater detail below, the utility mount light 10 is configured to be attached to a bucket of an elevated work platform (i.e., boom lift, man lift, basket crane, hydraladder, cherry picker, etc.), other components such as tables, or to a workpiece using the handle 22. For convenience, the component to which the light 10 attaches will hereinafter be referred to as a workpiece. Once the light 10 is mounted to the workpiece, the rotatable light head assemblies 26 may be rotated as desired to illuminate a work area.

Figure 2:
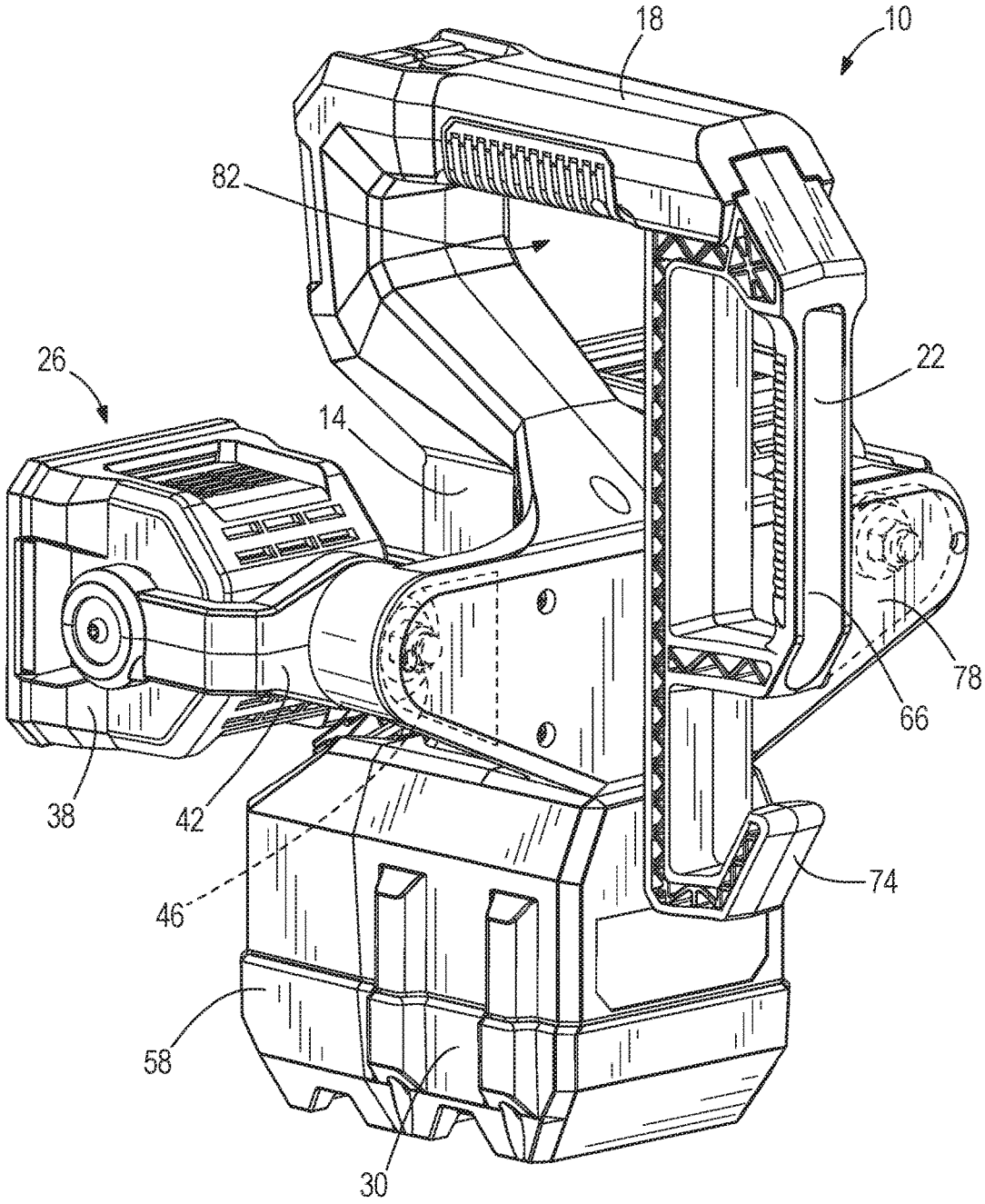
FIG. 2 is a rear perspective view of the utility mount light.

With reference to FIGS. 1 and 2, the light assemblies 26 each include a light housing 38 that is pivotally coupled between two opposed arms of a yoke 42 for pivoting motion about a first pivot axis A such that a direction of the light housing 38 is adjustable by a user. Each of the light housings 38 is independently rotatable to enhance the ability to direct the light as desired. In one embodiment, a pivoting range of the light housing 38 within the yoke 42 may be limited to approximately 180° about the first pivot axis A (e.g., via stops within the yoke 42). In another embodiment, the light housing 38 may pivot 360° about the first pivot axis A within the yoke 42. In other embodiments, the light housing 38 may have a discrete pivot range about the first pivot axis A within the yoke 42 (e.g., any discrete pivot range between 0-360°).

The yoke 42 is further coupled to the main housing 14 via a joint 46 that may be rotatable about a second pivot axis B that is orthogonal to the first pivot axis A such that a rotational orientation of the yoke 42 is adjustable by a user. In some embodiments, the yoke 42 is coupled to the main housing via a joint 46 that is rotatable 360° about the second pivot axis B. In other embodiments, the yoke 42 is coupled to the main housing 14 via a joint 46 that limits rotation (e.g., using stops in the joint 46). For example, rotation may be limited to discrete angles less than 360° but more than 180°, or rotation may be limited to discrete angles less than or equal to 180°. These configurations allow the light assemblies 26 to be directed in a variety of directions and orientations, and also allow the light assemblies 26 to be movable independently of one another.

In one embodiment, the light housing 38 may be fixed within the yoke 42 (i.e., the light housing is not pivotable) while the yoke 42 is rotatably coupled to the main housing 14 via a joint 46 that permits rotation as described above. In another embodiment, the yoke 42 may be fixedly coupled to the main housing 14 (i.e., the yoke 42 is not rotatable) while the light housing 38 is pivotable within the yoke 42 as described above. In yet another embodiment, the light housing 38 may be fixed within the yoke 42 (i.e., the light housing is not pivotable) and the yoke 42 may be fixedly coupled to the main housing 14 (i.e., the yoke 42 is not rotatable).

Figure 3:
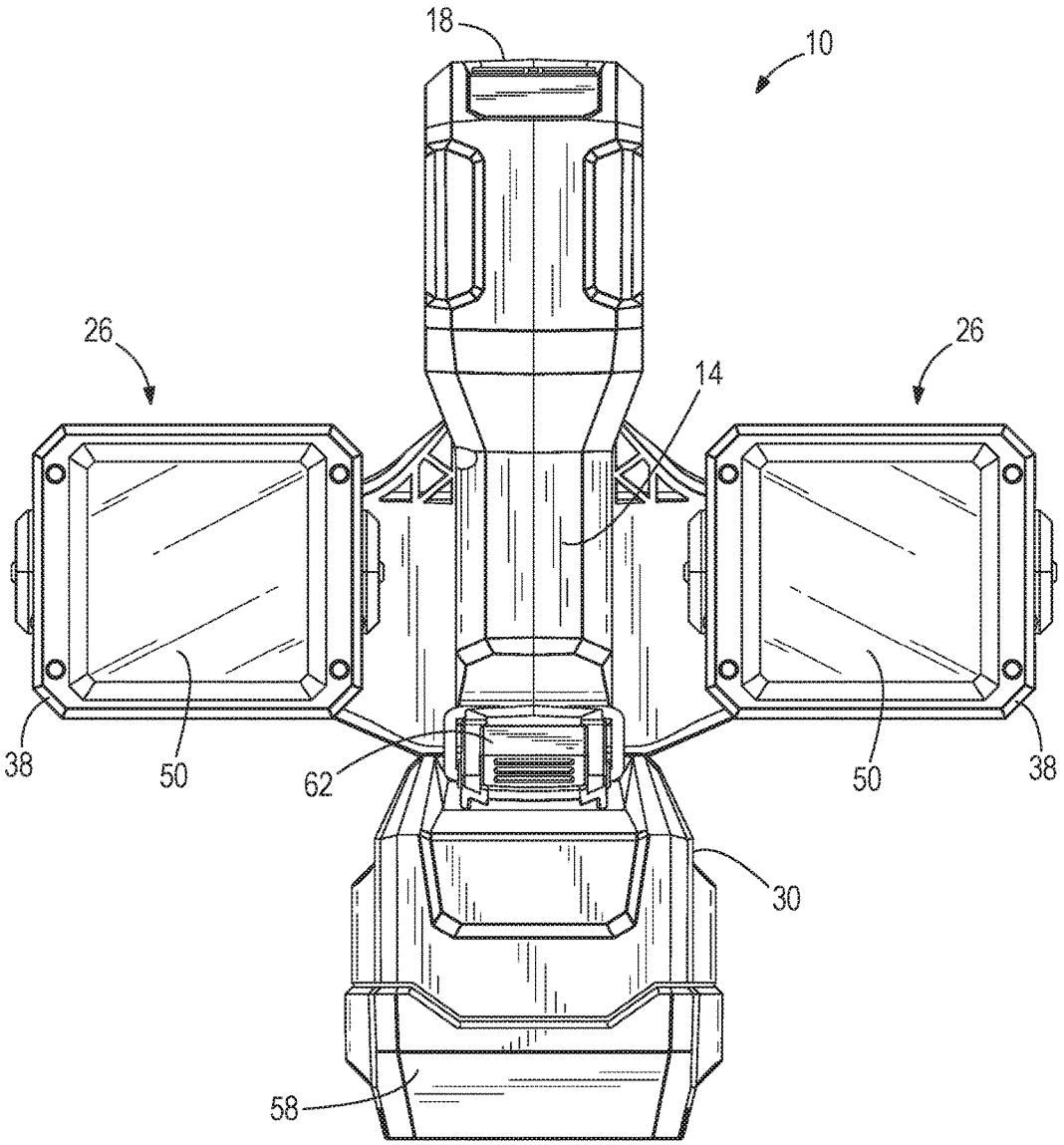
FIG. 3 is a front view of the utility mount light.

As seen in FIG. 3, the light assemblies 26 are disposed on opposing sides of the main housing 14 and the battery support portion 30.

The light housings 38 further support a plurality of lights. The lights may be, for example, spot LEDs, flood LEDs, a fluorescent bulb, an incandescent bulb, or any other suitable lighting elements. In a preferred embodiment, the lights supported within the light housing 30 are a combination of multiple spot LEDs and/or multiple flood LEDs configured to be operated separately and/or in tandem. The lights may be surrounded by a light guide disposed within the housing that directs light through lenses 50 of the light assemblies 26.

Figure 6:
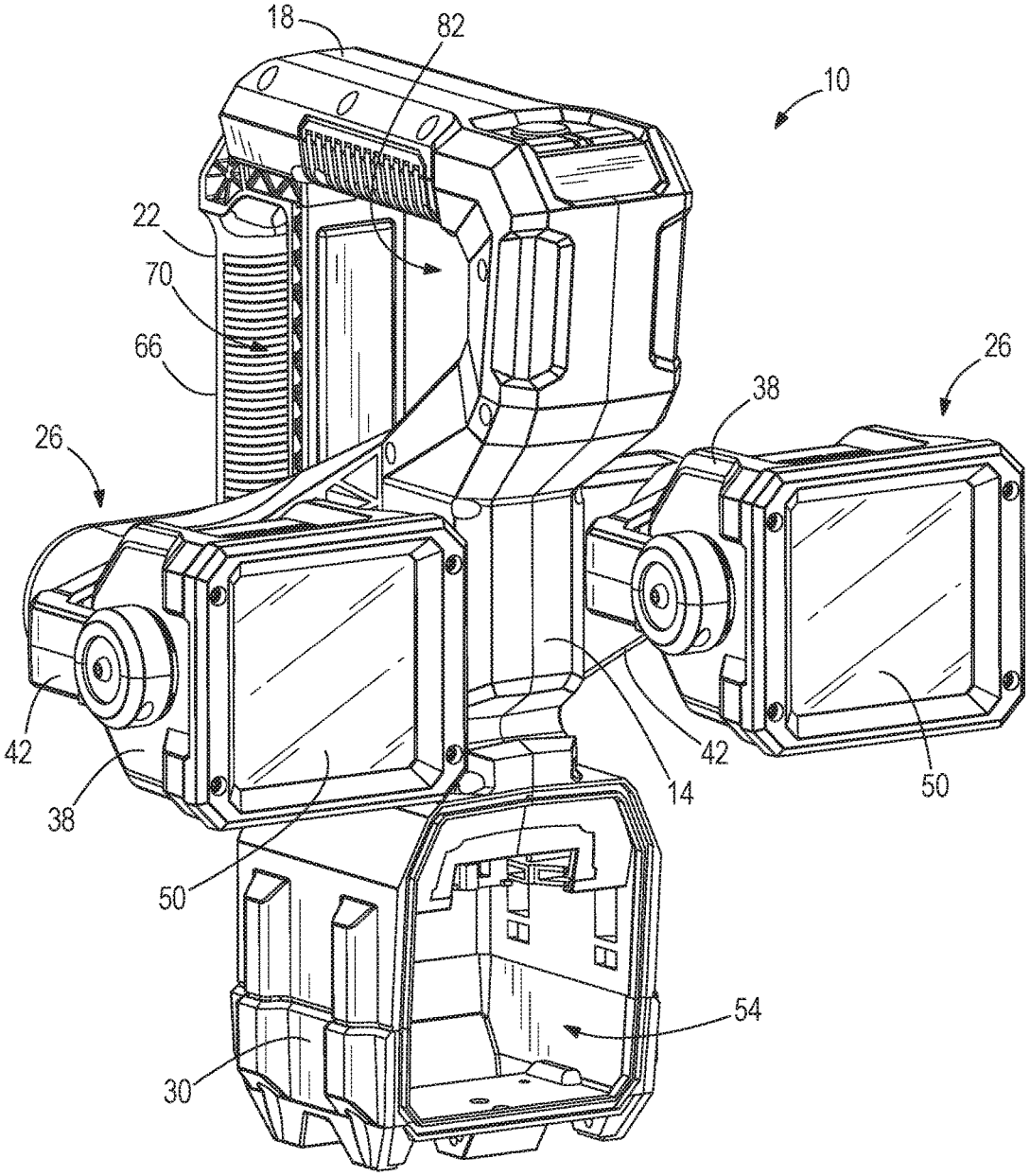
FIG. 6 is a second front perspective view with a door of a battery support portion of the utility mount light removed.

With reference to FIGS. 1 and 6, the battery support portion 30 is formed as one piece with the main housing 14 and is configured to detachably couple the battery pack. In the illustrated embodiment, the battery support portion 30 defines a cavity 54 for receiving the battery pack (FIG. 6). A door 58 is pivotally coupled to the battery support portion 30 at an open end of the cavity, and is releasably secured to the casing via a latch 62. The door 58 is further configured to sealingly engage the open end of the cavity such that, when the battery pack is secured within the cavity 54, no water or contaminants may enter the cavity 54. The sealed engagement may be accomplished by, for example, providing a gasket, an O-ring, a deformable member, or other sealing member to one or both of the battery support portion 30 and the door 58. In preferred constructions, the battery pack is a power tool battery pack.

With reference to FIG. 1, the handle portion 18 includes a power actuator, a first mode actuator, and a second mode actuator (e.g., buttons, trigger switches, knobs, etc.). Each of the actuators may be coupled to a processor supported within the utility mount light 10. The processor is coupled to the lights within each of the light housings 38 and to the battery pack control to the power supplied by the battery pack to each of the light assemblies. In some constructions, some or all of the actuators may be virtual controls (e.g., touch screens) rather than real buttons, switches, or knobs.

The processor is implemented as a microprocessor including a non-transitory, computer-readable memory that stores executable instructions to carry out functionalities of the utility mount light 10. The processor 12 may be implemented partially or entirely as, for example, a field-programmable gate array (FPGA), and application specific integrated circuit (ASIC).

The power actuator may be operated by a user to simultaneously turn both light assemblies 26 on or off. The first mode actuator may be successively operated by a user to cycle one of the light assemblies 26 through a plurality of modes, and the second mode actuator may be successively operated by a user to cycle the other light assembly 26 through the plurality of modes. The plurality of modes may include, for example, a spot mode in which spot LEDs are activated, a flood mode in which flood LEDs are activated, spot/flood mode in which both spot LEDs and flood LEDs are activated, and an off mode (i.e., such that each light assembly 26 may be independently turned off). In one embodiment, the plurality of modes may further include brightness modes for one or more of the spot mode, the flood mode, and the spot/flood mode. In another embodiment, the plurality of modes may be a multiple discrete brightness modes (e.g., low/medium/high, etc.).

In another embodiment, the utility mount light 10 may include separate power actuators for each light, such that there is a first power actuator, a second power actuator, a first mode switch, and a second mode switch. In such an embodiment, the first power actuator controls the on/off state of one of the light assemblies 26, while the second power actuator controls the on/off state of the other light assembly 26.

In yet another embodiment, the utility mount light may include a first actuator and a second actuator. In this embodiment, the first actuator is configured to operate one of the light assemblies 26 while the second actuator is configured to operate the other light assembly. The first actuator may be successively operated by a user to turn the light assembly 26 on, cycle the light assembly 26 through a plurality of modes, and turn the light assembly 26 off. The second actuator may be successively operated by a user to turn the other light assembly 26 on, cycle the other light assembly 26 through a plurality of modes, and turn the other light assembly 26 off.

In any of the embodiments described above, it should be clear that each light assembly 26 may be individually operated (i.e., turned on/off) and/or individually cycled through the plurality of modes such that the light assemblies 26 may be in independent operating states.

Figure 4:
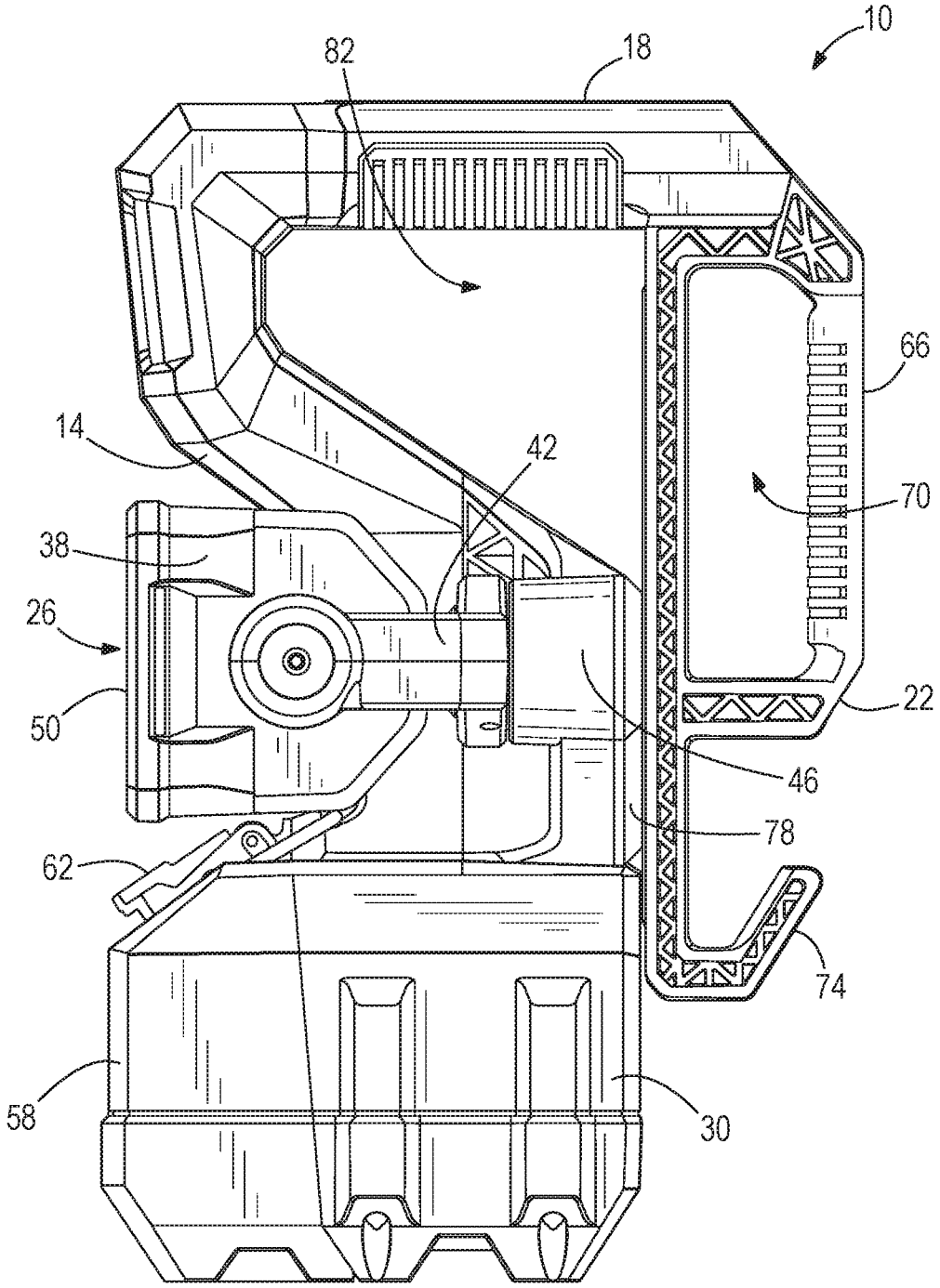
FIG. 4 is a side view of the utility mount light.
Figure 5:
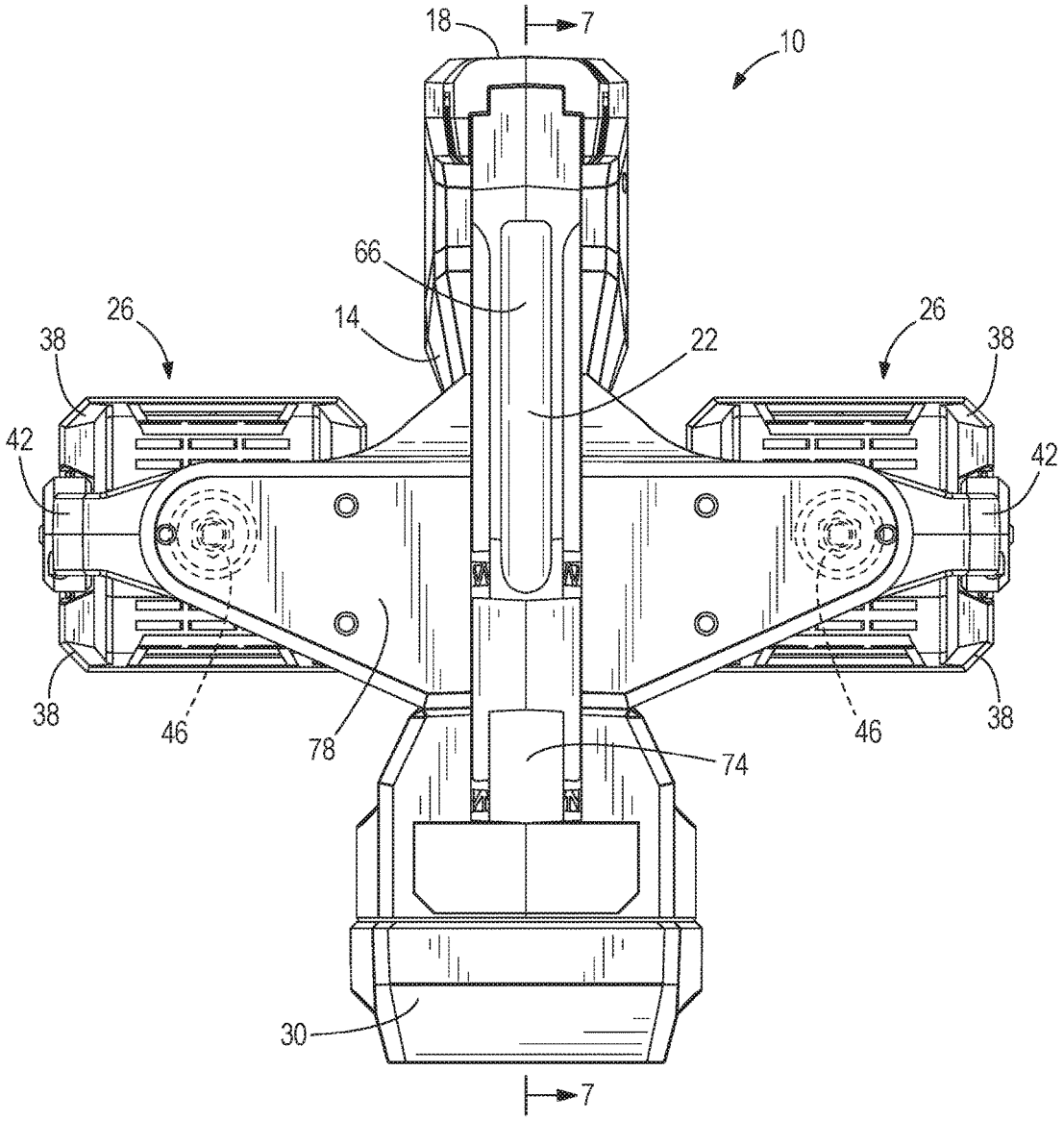
FIG. 5 is a rear view of the utility mount light.
Figure 7:
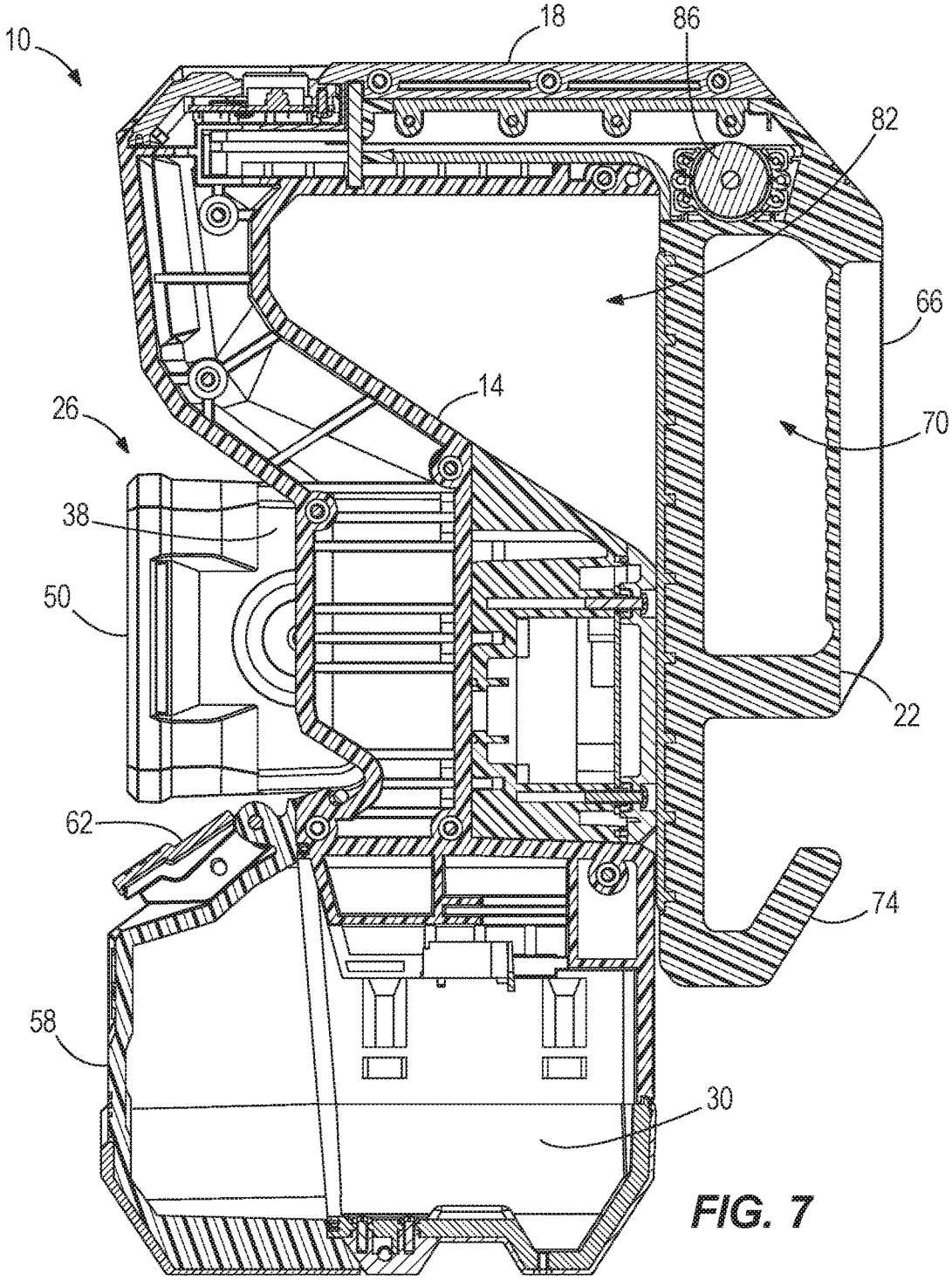
FIG. 7 is a side view of a cross section taken along line 7-7 in FIG. 3.
Figure 8:
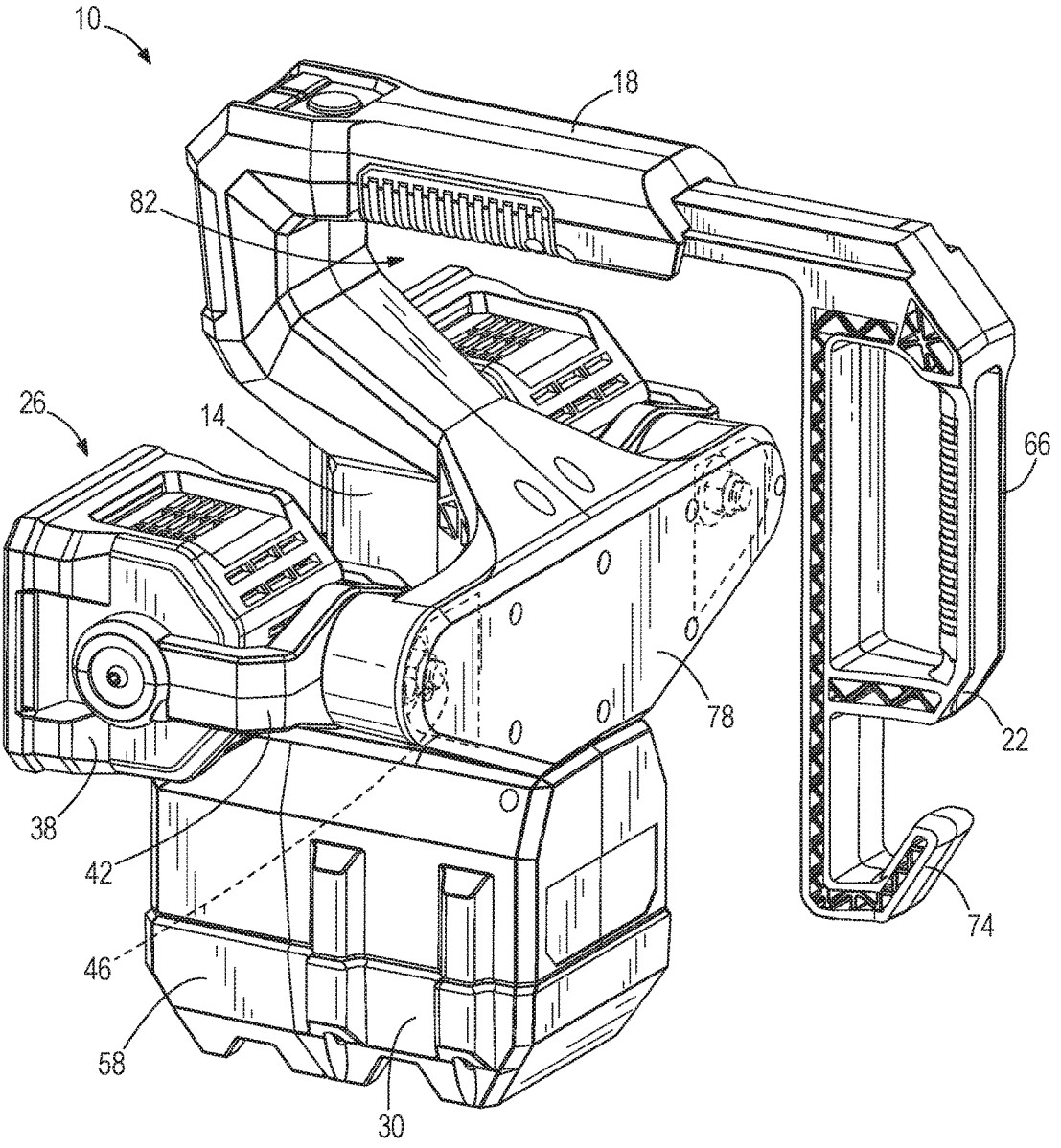
FIG. 8 is a perspective view of the utility mount light with the handle in an open or extended position.

With reference to FIGS. 2 and 4, the handle 22 includes a gripping portion 66 defined by an aperture 70 extending through the handle 22, and a hook portion 74 adjacent the gripping portion 66. The handle 22 is movably coupled to the handle portion 18 at an end adjacent the gripping portion 66, and is biased by a constant force or a clock spring 86 (FIG. 7) toward a closed position (FIG. 4) where the handle 22 maintains contact with a workpiece and/or an opposing support surface 78 disposed on the main housing 14. However, in other embodiments, other biasing members such as a torsion spring, a helical spring, or an adjustable spiral spring, among others, may be used in place of or in conjunction with the constant force spring 86. The handle 22 is movable in a linear direction to an open or extended position (FIG. 8) away from the support surface 78 (i.e., the handle 22 is linearly extensible). In addition, when the handle 22 is extended away from the support surface 78, an opening 82 is defined between the handle portion 18, the handle 22, and the main housing 14. The opening 82 is configured to receive a portion or a lip of the work platform (i.e., boom lift, man lift, basket crane, hydraladder, cherry picker, etc.) or the workpiece. In addition, the size of the opening 82 is such that it can receive a variety of differently sized lips.

In operation, the utility mount light 10 may be attached to a work platform or a workpiece using the handle 22. A user may grasp the gripping portion 66 and the main housing 14, for example, and pull the handle 22 against the bias of the constant force spring 86 toward the open position to disengage contact between the handle 22 and the support surface 78 to create a gap. The handle 22 and support surface 78 may then be placed on opposing sides of a workpiece or a work platform (i.e., a bucket, etc.) and subsequently released such that the bias of the constant force spring 86 pulls the handle 22 toward the support surface 78 to clamp the work platform or workpiece between the handle 22 and the support surface 78. In one embodiment, the movable range of the handle 22 may be limited such that the maximum gap is approximately 3.5 inches.

The utility mount light 10 may be detached from a work platform or workpiece by pulling the handle 22 against the bias of the constant force spring 86 to open a gap between the work platform or workpiece and the handle 22 and/or the support surface 78 (i.e., un-clamp the utility mount light 10 form the work platform or workpiece). However, pulling the handle 22 may not be required in some embodiments. For example, the biasing force of the constant force spring 86 may be set such that the spring 86 retracts the handle and provides the desired clamping/frictional force on the work platform or workpiece, but allows the user to detach the utility mount light 10 from the work platform or workpiece by grasping the handle portion 18 and lifting the utility mount light 10 away from the workpiece. Using this method, a user can remove the light 10 with one hand by simply grasping the handle portion 18 and pulling the light upward.

It should be noted that the placement of the gripping portion 66 of the handle 22 adjacent to the handle portion 18 provides certain advantages. This placement reduces the distance between a gripping portion 66 and the spring, thereby reducing rotational torquing on the handle 22 and the spring during operation thereby increasing the operational life.

In addition, the linearly displaceable handle 22 advantageously allows the utility light 10 to be coupled to work platforms or workpieces of various sizes (e.g., various widths).

Various features of the invention are set forth in the following claims.

What is claimed is:

1. A utility light comprising:

a main body;

a light assembly defined on the main body including a light source disposed within a light housing, the light housing being pivotable and rotatable relative to the main body; and a handle movably coupled to the main body, the handle being linearly extensible relative to the main body to a position in which an opening is defined between the handle and the main body, such that the opening is configured to receive a workpiece to support the utility light, the handle having a gripping portion configured to be grasped by a user's hand while the utility light is supported by the workpiece, wherein the handle is biased by a constant force spring.

2. The utility light of claim 1, wherein the light assembly is a first light assembly, and the main body further includes a second light assembly defined on the main body including a second light source disposed within a second light housing, the second light housing being pivotable and rotatable relative to the main body.

3. The utility light of claim 1, wherein the light housing is supported for pivoting movement within a yoke that is rotatably coupled to the main body.

4. The utility light of claim 3, wherein the yoke is rotatable 180 degrees relative to the main body.

5. The utility light of claim 1, further including a battery support portion defined on the main body configured to receive a battery that provides power to the light source.

6. A utility light comprising:

a main body;

a first light assembly defined on the main body including a first light source disposed within a first light housing, the first light housing being pivotable and rotatable relative to the main body;

a second light assembly defined on the main body including a second light source disposed within a second light housing, the second light housing being pivotable and rotatable relative to the main body; and a handle including a portion that is movably coupled to the main body, the handle being linearly extensible relative to the main body and biased toward the main body such that the handle is configured to clamp a workpiece between the handle and the main body.

7. The utility light of claim 6, wherein the first light assembly and the second light assembly are disposed on opposing sides of the main body.

8. The utility light of claim 6, wherein the first light housing is pivotally supported between opposed arms of a first yoke that is rotatably coupled to the main body, and the second light housing is pivotally supported between opposed arms of a second yoke that is rotatably coupled to the main body.

9. The utility light of claim 6, wherein the handle includes a gripping portion defined by an aperture extending through the handle.

10. The utility light of claim 6, wherein the handle is biased towards the main body by a constant force spring.

11. The utility light of claim 9, wherein the handle includes a hook portion adjacent the gripping portion.

12. A utility light comprising:

a main body;

a handle movably coupled to the main body, the handle being linearly extensible in a first direction relative to the main body and biased toward the main body in a second direction that is opposite the first direction;

a first light assembly defined on the main body including a first light source disposed within a first light housing, the first light housing being pivotally supported within a first yoke that is rotatable relative to the main body; and a second light assembly defined on the main body including a second light source disposed within a second light housing, the second light housing being pivotally supported within a second yoke that is rotatable relative to the main body.

13. The utility light of claim 12, further including a battery support portion that receives a battery configured to provide power to each of the first light assembly and the second light assembly.

14. The utility light of claim 13, wherein the battery support portion extends from the main body between the first light assembly and the second light assembly.

15. The utility light of claim 12, wherein the handle includes a gripping portion defined by an aperture extending through the handle.

16. The utility light of claim 15, wherein the handle includes a hook portion adjacent the gripping portion.

17. The utility light of claim 16, wherein the handle is biased toward the main body by a constant force spring.

18. The utility light of claim 12, wherein the first light assembly and the second light assembly are disposed on opposite sides of the main body.

* * * * *